US006966640B2

(12) United States Patent
Lee

(10) Patent No.: US 6,966,640 B2
(45) Date of Patent: Nov. 22, 2005

(54) INK CARTRIDGE FOR AN INK JET PRINTER

(76) Inventor: Teng-Kuei Lee, No. 14, Alley 6, Lane 500, Wu-Chuan Rd., Taichung City (TW)

( * ) Notice: Subject to any disclaimer, the term of this patent is extended or adjusted under 35 U.S.C. 154(b) by 154 days.

(21) Appl. No.: 10/684,888

(22) Filed: Oct. 14, 2003

(65) Prior Publication Data

US 2005/0078156 A1 Apr. 14, 2005

(51) Int. Cl.[7] ..... B41J 2/175
(52) U.S. Cl. ..... 347/86
(58) Field of Search ..... 347/84, 85, 86, 347/87

(56) References Cited

U.S. PATENT DOCUMENTS 5,751,319 A * 5/1998 Robertson et al. ..... 347/85
6,293,663 B1 * 9/2001 Koshikawa et al. ..... 347/86
6,520,630 B1 * 2/2003 Oda et al. ..... 347/85
6,742,880 B2 * 6/2004 Jones et al. ..... 347/86
6,877,846 B2 * 4/2005 Fellingham et al. ..... 347/85

* cited by examiner

*Primary Examiner*—Anh T.N. Vo
(74) *Attorney, Agent, or Firm*—Ladas & Parry LLP

(57) ABSTRACT

An ink cartridge includes an ink supplying member and an ink reservoir which are communicated with each other by a conduit, an ink absorbent body received in an ink-holding zone of the ink supplying member and disposed to discharge the ink held therein in response to activation of a recording head of an ink jet printer, and a conduit having an intake end dipped in the ink in the ink reservoir, and an output end downstream of the inlet port of the ink supplying member such that the ink in the ink reservoir is suctioned through the conduit into the ink supplying member when the recording head is actuated.

8 Claims, 7 Drawing Sheets

INK CARTRIDGE FOR AN INK JET PRINTER

BACKGROUND OF THE INVENTION

1. Field of the Invention

This invention relates to an ink cartridge, more particularly to an ink cartridge with an ink supplying chamber and an ink reservoir which are communicated with each other by a conduit for continuously supplying ink to a recording head of an ink jet printer.

2. Description of the Related Art

Referring to FIG. 1, a conventional ink cartridge 1 is shown to include a cartridge body 10 in which an ink absorbent sponge 14 is received for holding ink therein by capillary action. The cartridge body 10 has a supplying port 11 formed in a bottom wall, and an ink refilling port 12 and a vent hole 13 formed in an upper wall. In use, responsive to an activation of a recording head (not shown) of an ink jet printer, the ink is delivered through the supplying port 11 to the recording head. When the ink is exhausted, a barrel-like ink filler 15 is connected to the ink refilling port 12 for refilling the cartridge body 10 with ink. During the refilling process, since the ink is held in pores of the sponge 14 by capillary action, the ink is introduced from the ink filler 15 into the cartridge body 10 very slowly to prevent undesired leakage, thereby resulting in inconvenient operation.

Referring to FIG. 2, another conventional ink cartridge 2 is shown to include a cartridge body 20 in which a partition wall 21 is disposed to divide the cartridge body 20 into an ink supplying chamber 22 and an ink reservoir 23. An ink absorbent sponge 25 is received in the ink supplying chamber 22 to supply ink therein to a recording head (not shown) through a supplying port 24. A passage 27 is formed in a lower end of the partition wall 21 to permit ink in the ink reservoir 23 to continuously enter the ink supplying chamber 22. An ink refilling port 26 is provided for refilling the ink reservoir 23 with ink. In this construction, however, due to gravitational force, when the ink refilling port 26 is open, the ink in the ink reservoir 23 will be attracted by the sponge 25 via the passage 27 so that an excess amount of ink is held in the sponge 25. As a result, ink may leak through the supplying port 24 during a printing process, which is wasteful and will adversely affect the printing quality.

SUMMARY OF THE INVENTION

The object of the present invention is to provide an ink cartridge which is able to continuously supply ink to a recording head and which can improve the printing quality.

According to this invention, the ink cartridge includes an ink supplying member, an ink absorbent body, an ink reservoir, and a conduit.

The ink supplying member defines a supplying chamber for holding the ink therein, and includes a supplying port that is in fluid communication with the supplying chamber, and that is adapted for passage of the ink therethrough to be supplied a recording head of an ink jet printer in response to an activation of the recording head, and an inlet port that is disposed upstream of the supplying port. The supplying chamber has an ink-flow inducing zone and an ink-holding zone disposed immediately downstream and upstream of the inlet port and the supplying port, respectively.

The ink absorbent body is made of such a material as to hold the ink in voids thereof by capillary action in a saturated state, and to discharge the ink held therein in response to the activation of the recording head so that the ink in the voids is partially depleted in the ink absorbent body, thereby placing the ink absorbent body in an unsaturated state. The ink absorbent body is configured to be received in the ink-holding zone. As such, in both the saturated and unsaturated states, the ink-flow inducing zone is air-tightly cut off from the supplying port by the ink absorbent body. In the unsaturated state, the air in the ink-flow inducing zone takes the place of the depleted ink and refills the voids, thereby creating a reduced pressure in the ink-flow inducing zone.

The ink reservoir contains ink with a liquid level, and is disposed upstream of the inlet port.

The conduit has an intake end which is dipped in the ink below the liquid level, and an output end which is downstream of the intake end, and which is disposed in fluid communication with the inlet port. As such, when the reduced pressure is created in the ink-flow inducing zone, the ink in the ink reservoir is suctioned through the conduit into the ink-flow inducing zone to replenish the voids with ink, thereby placing the ink absorbent body to the saturated state.

BRIEF DESCRIPTION OF THE DRAWINGS

Other features and advantages of the present invention will become apparent in the following detailed description of the preferred embodiments of the invention, with reference to the accompanying drawings, in which.

DETAILED DESCRIPTION OF THE PREFERRED EMBODIMENTS

Figure 1:
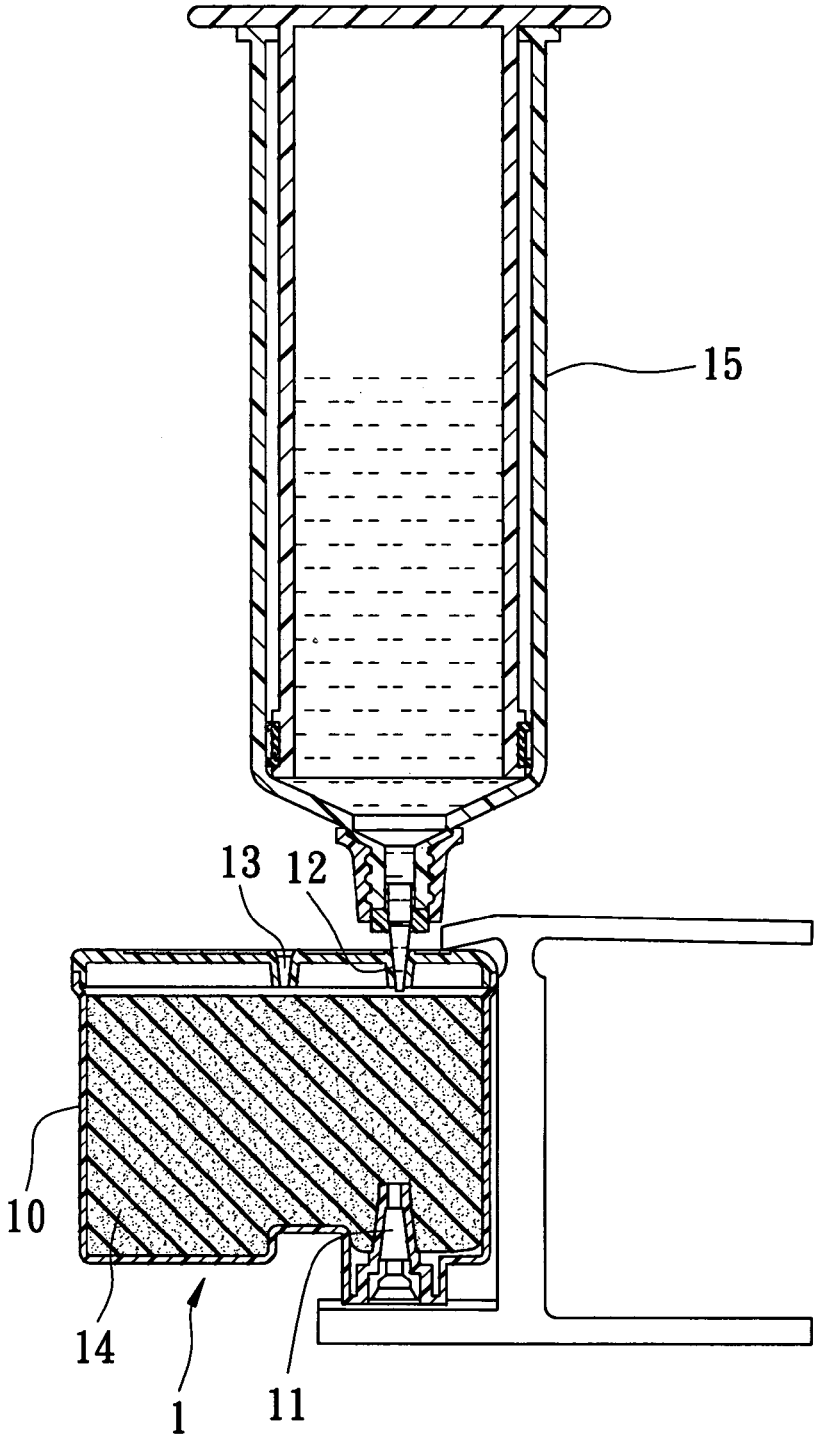
FIG. 1 PRIOR ART
FIG. 1 is a sectional view of a conventional ink cartridge.
Figure 2:
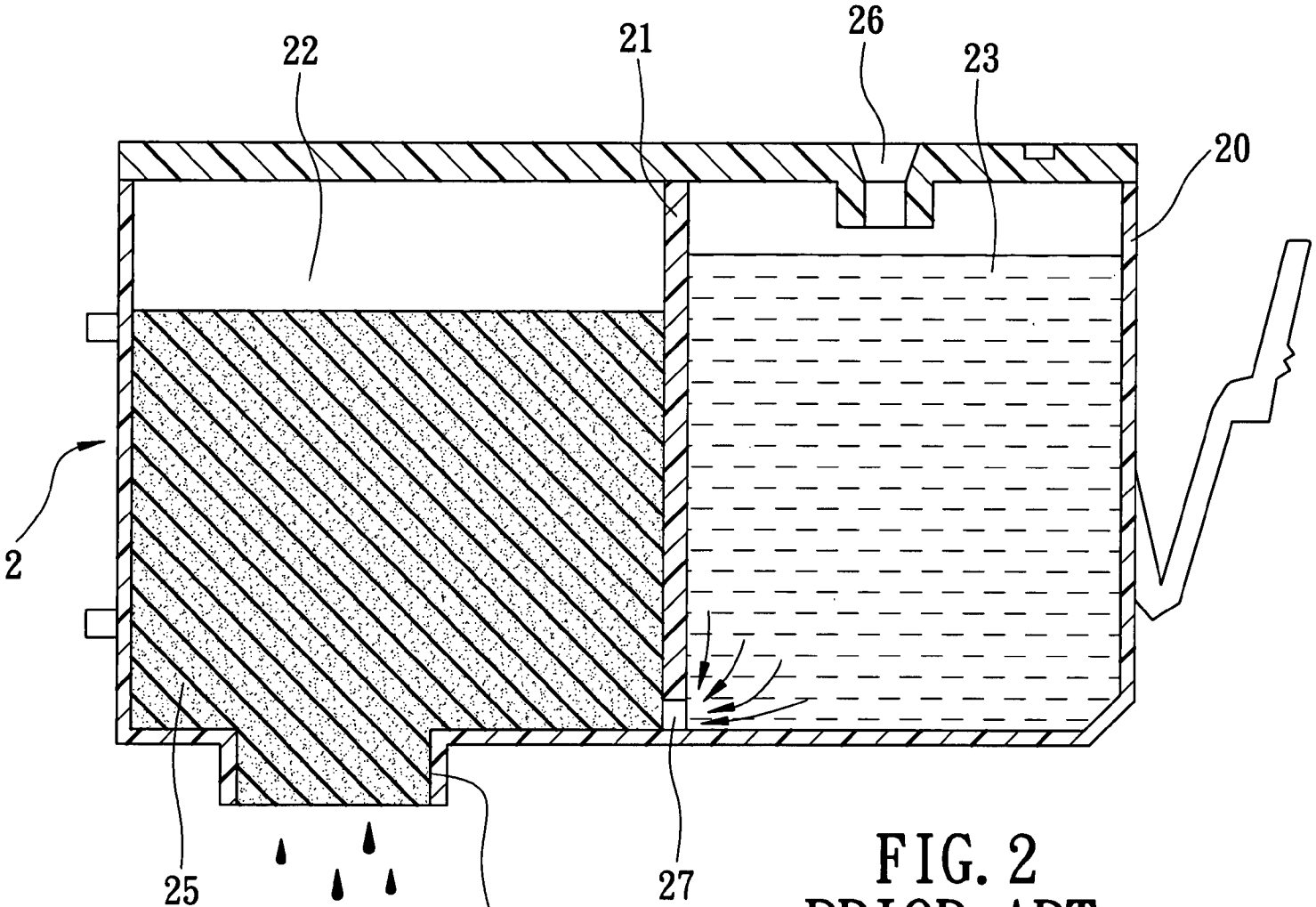
FIG. 2 PRIOR ART
FIG. 2 is a sectional view of another conventional ink cartridge.
Figure 3:
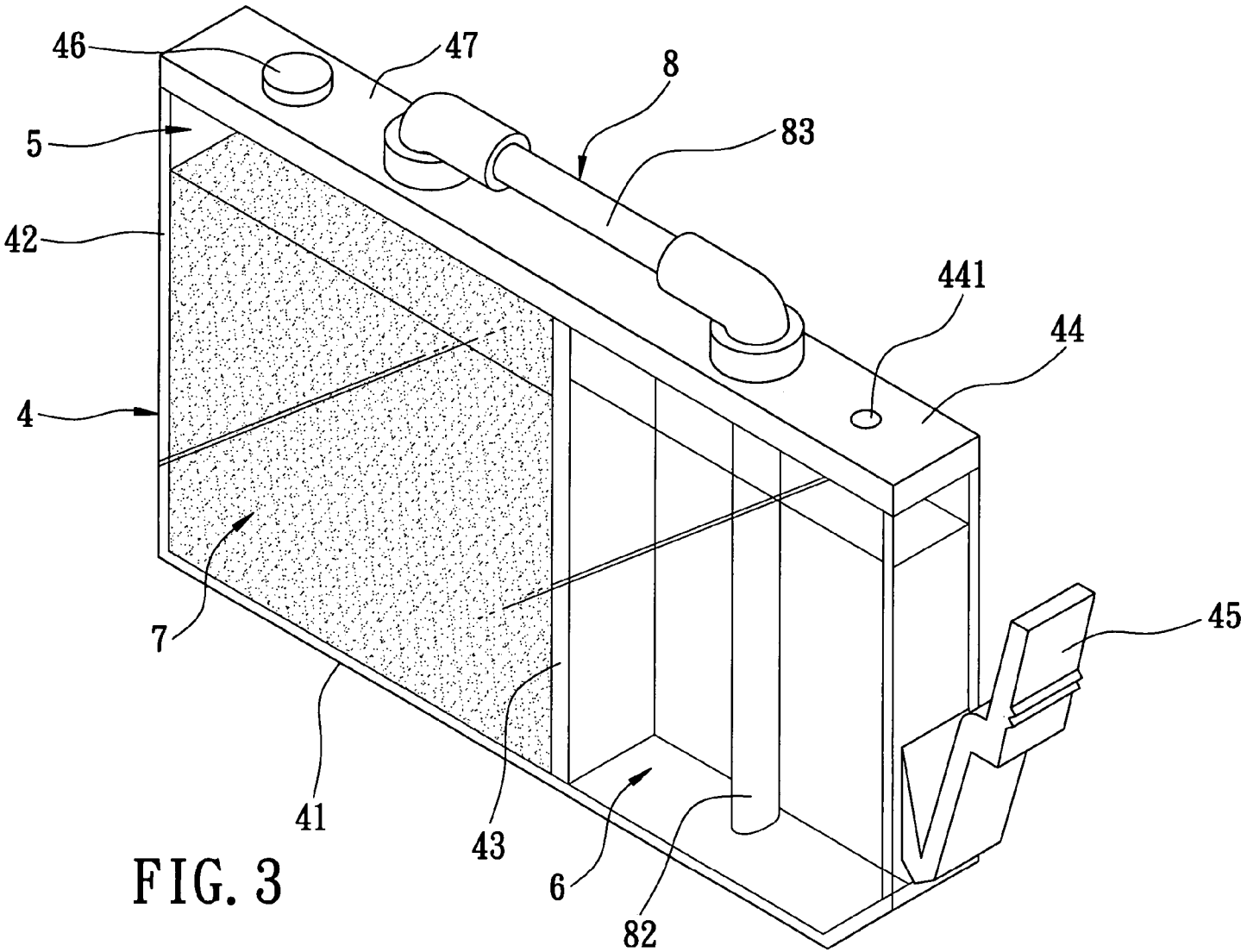
FIG. 3 is a perspective view of the first preferred embodiment of an ink cartridge according to this invention.
Figure 4:
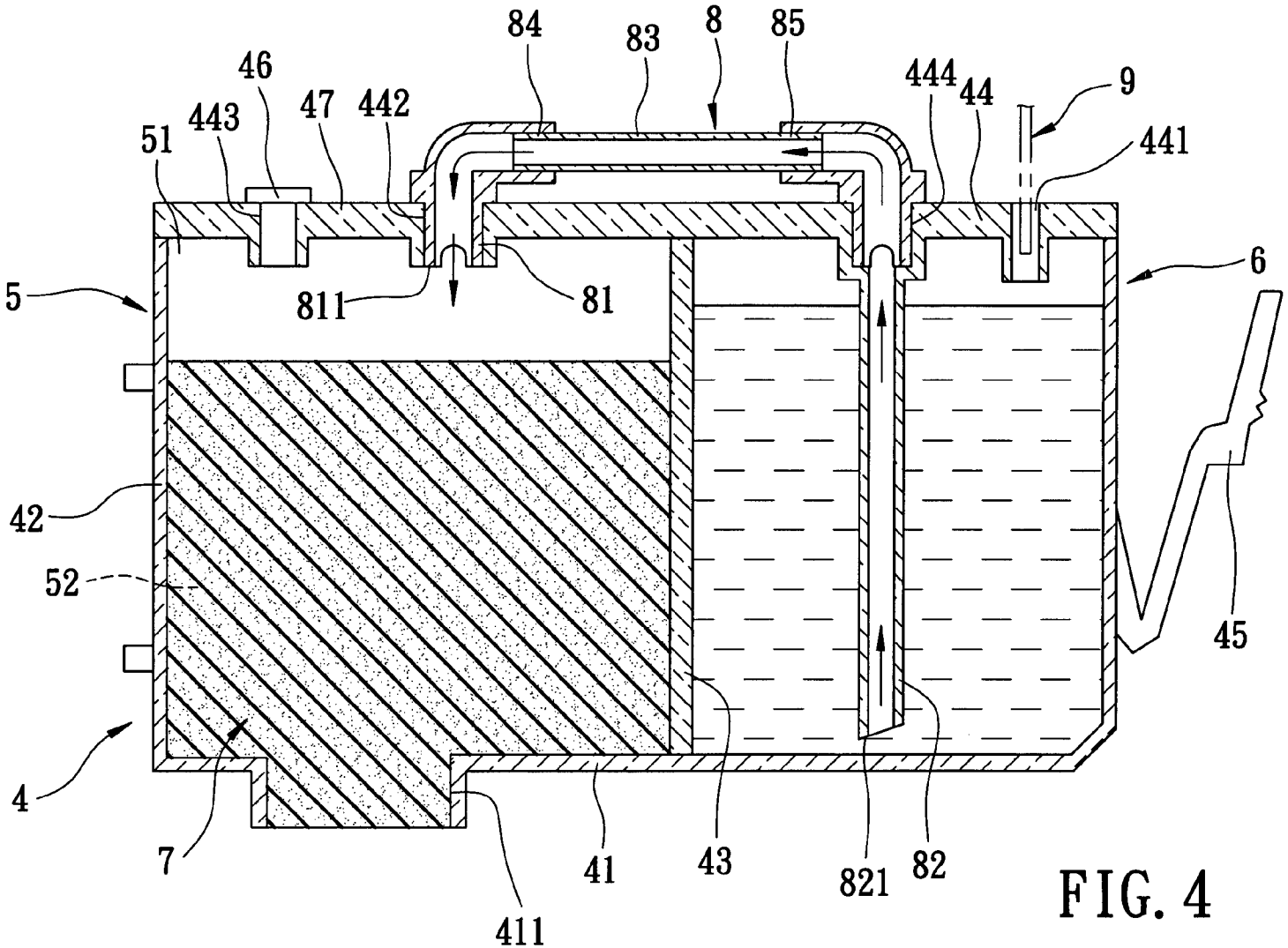
FIG. 4 is a sectional view of the first preferred embodiment.
Figure 5:
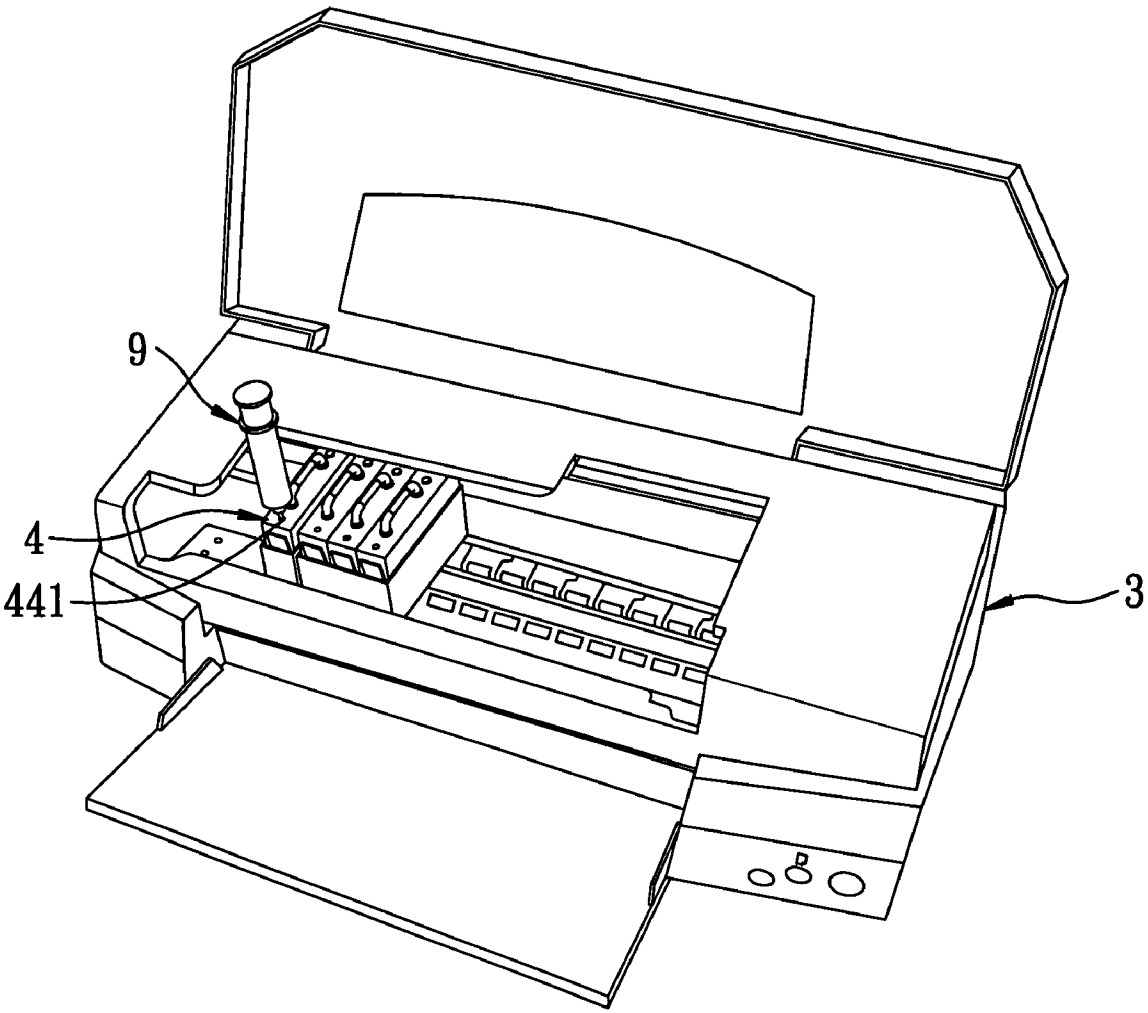
FIG. 5 is a perspective view of the first preferred embodiment when mounted in an ink jet printer.

Referring to FIGS. 3 to 5, the first preferred embodiment of an ink cartridge according to the present invention is shown to be mounted in an ink jet printer 3, and comprises a cartridge body 4 which is molded into a one-piece construction from a transparent material and which includes an ink supplying member 5 and an ink reservoir 6 that are juxtaposed and that are partitioned by a partition wall 43, an ink absorbent body 7, and a conduit 8. FIG. 5 shows four ink cartridges of this embodiment mounted in the ink jet printer 3.

The ink supplying member 5 includes a bottom wall 41 which is formed with a lower hole that serves as a supplying port 411, and a first top wall 47 which is spaced apart from the bottom wall 41 in an upright direction to cooperate with the bottom wall 41 to define a supplying chamber therebetween for holding the ink. The supplying port 411 is in fluid communication with the supplying chamber, and is adapted for passage of the ink therethrough to be applied to a recording head (not shown) of the ink jet printer 3 in response to activation of the recording head. A first upper hole is formed in the first top wall 47 to serve as an inlet port 442 that is disposed upstream of the supplying port 411. The supplying chamber includes an ink-flow inducing zone 51 and an ink-holding zone 52, which are disposed immediately downstream and upstream of the inlet port 442 and the supplying port 411, respectively, and which are opposite to each other in the upright direction. Further, a vent hole 443 is formed in the first top wall 47 to communicate the ink-flow inducing zone 51 with the outside. A cap 46 is detachably mounted in the vent hole 443.

The ink absorbent body 7 is made of such a material as to hold the ink in voids thereof by capillary action in a saturated state, such as a porous sponge which has a plurality of pores that serve as the voids, and is configured to be received in the ink-holding zone 52. The ink absorbent body 7 can discharge the ink in response to the activation of the recording head in a known manner so that the ink in the voids is partially depleted, thereby placing the ink absorbent body 7 in an unsaturated state. As such, the ink-flow inducing zone 51 is air-tightly cut off from the supplying port 411 by the ink absorbent body 7 in both the saturated and unsaturated states. In the unsaturated state, the air in the ink-flow inducing zone 51 takes the place of the depleted ink and refills the voids, thereby creating a reduced pressure in the ink-flow inducing zone 51.

The ink reservoir 6 is disposed to contain ink with a liquid level, and includes a second top wall 44 which is formed integrally with and which is disposed opposite to the first top wall 47 in a transverse direction relative to the upright direction, and which has a second upper hole 444 and an ink refilling port 441.

The conduit 8 includes an output tube 81 which is coupled with the inlet port 442 and which has an output end 811 in fluid communication with the ink-flow inducing zone 51, an intake tube 82 which extends through the second upper hole 444 into the ink reservoir 6 and which has an intake end 821 dipped in the ink below the liquid level, and a tubular portion 83 which is disposed outwardly of the cartridge body 4 and which has two ends 84,85 that are connected to and fluidly communicated with the output tube 81 and the intake tube 82, respectively. Preferably, the intake end 821 is lower than the output end 811.

When a reduced pressure is created in the ink-flow inducing zone 51, the ink in the ink reservoir 6 is suctioned through the conduit 8 (i.e. along a flowpath from the intake end 821 to the output end 811) into the ink-flow inducing zone 51 to replenish the voids of the ink absorbent body 7 with ink, thereby bringing the ink absorbent body 7 in the saturated state. Thus, the ink can be continuously supplied to the recording head of the printer 3 during the printing process. In addition, when the ink in the ink reservoir 6 is exhausted, an ink refilling tool 9 can be used to engage the ink refilling port 441 for refilling the reservoir 6 without the need to detach the ink cartridge from the printer 3.

Moreover, a leaf spring 45 is mounted on a surrounding wall 42 of the cartridge body 4 for facilitating fastening of the cartridge body 4 to the ink jet printer 3.

It is noted that if excess ink is introduced into the ink absorbent body 7 when the ink cartridge is used for the first time, the cap 46 can be removed from the vent hole 443 to stop the suction of ink from the ink reservoir 6 so as to permit discharge of the ink in the ink absorbent body 7 to the recording head in response to the activation of the recording head. The cap 46 can be put in place once again when the ink absorbent body 7 is in an appropriately saturated state.

Figure 6:
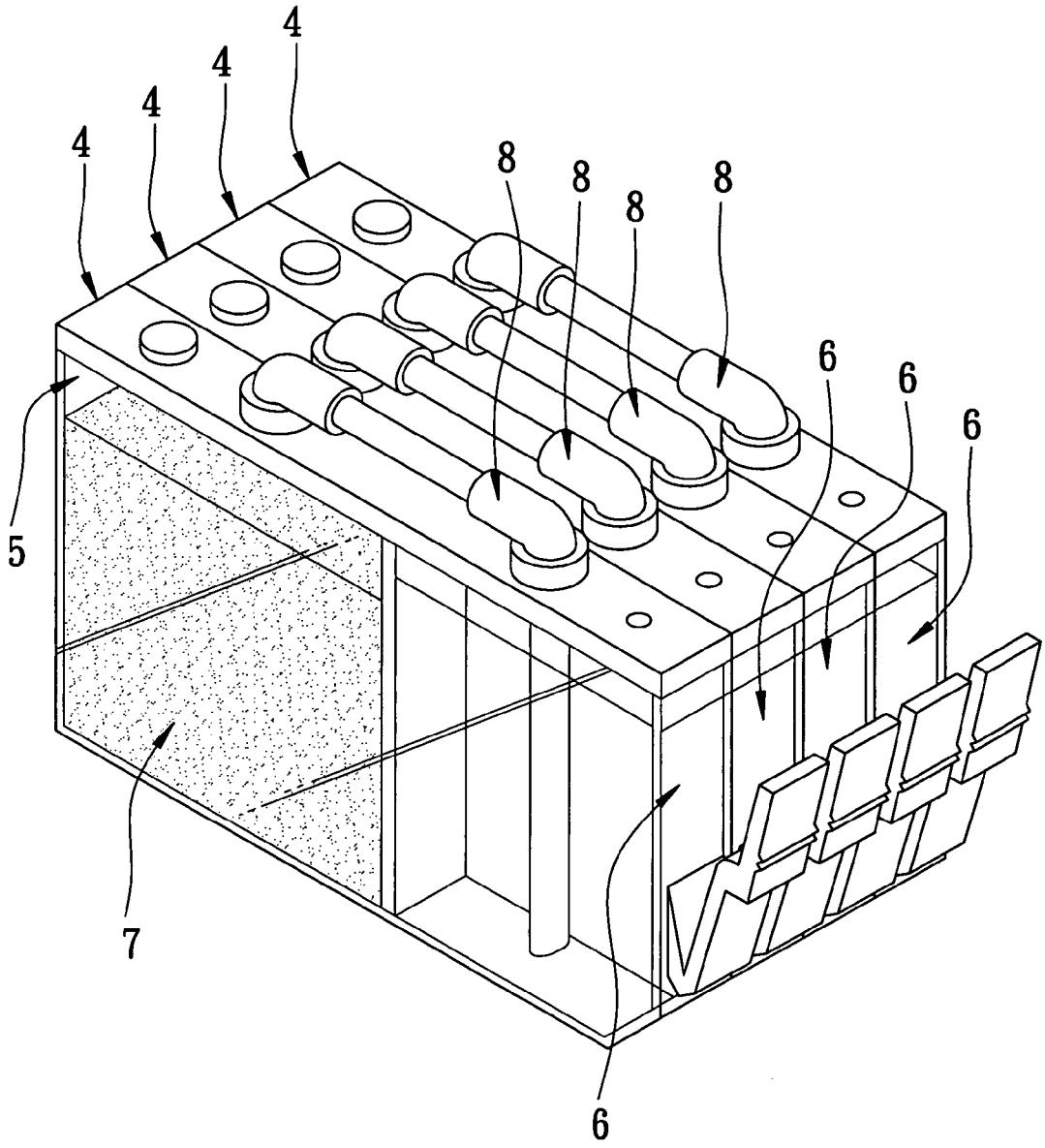
FIG. 6 is a perspective view showing four ink cartridge incorporating the first preferred embodiment.

FIG. 6 illustrates four ink cartridges of this embodiment. The ink cartridges can be filled with ink of different colors for mounting in the printer shown in FIG. 5 in a juxtaposed manner.

Figure 7:
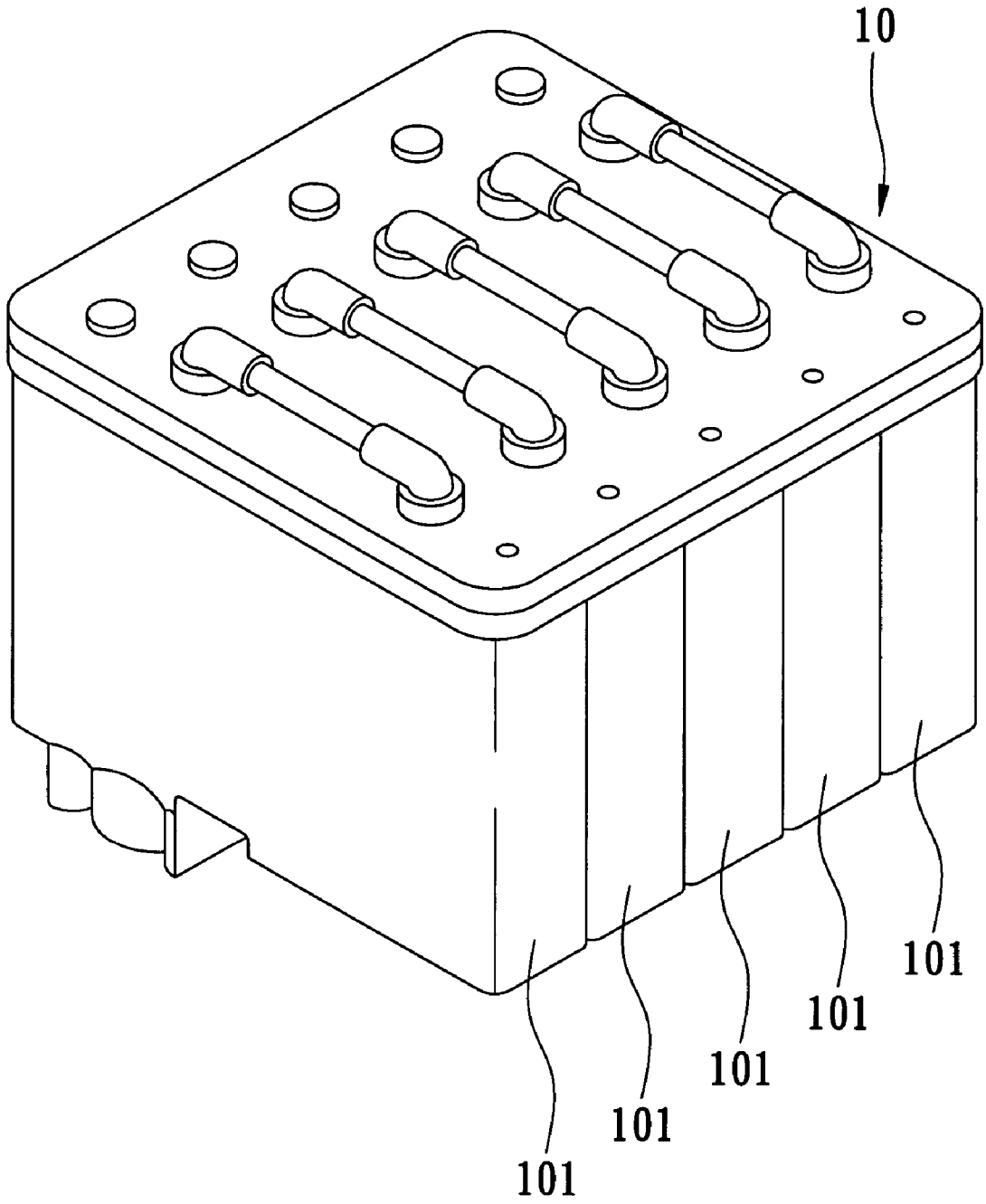
FIG. 7 is a perspective view of the second preferred embodiment of an ink cartridge according to this invention.

Referring to FIG. 7, the second preferred embodiment of an ink cartridge according to this invention is shown to include a molded cartridge body 10 which includes five juxtaposed compartments 101. Each of the compartments 101 includes an ink supplying member and an ink reservoir which are similar to those of the cartridge body 4 in the first embodiment, and is adapted to contain ink of a different color. An ink absorbent body and a conduit are disposed in each of the corresponding compartments 101 in the same manner as described in the first embodiment.

In the ink cartridge of this invention, by virtue of the conduit 8 that communicates the ink reservoir 6 with the ink supplying member 5, the ink in the ink reservoir 6 is suctioned through the conduit 8 into the ink-flow inducing zone 51 only when the recording head of the printer 3 is actuated, thereby preventing an excess amount of ink from being absorbed by the ink absorbent body 7 and thereby preventing waste of ink so as to improve the printing quality.

While the present invention has been described in connection with what is considered the most practical and preferred embodiments, it is understood that this invention is not limited to the disclosed embodiments but is intended to cover various arrangements included within the spirit and scope of the broadest interpretations and equivalent arrangements.

I claim:

1. An ink cartridge for supplying ink to a recording head of an ink jet printer, said ink cartridge comprising:

an ink supplying member which defines a supplying chamber for holding the ink therein, and which includes a supplying port that is in fluid communication with said supplying chamber, and that is adapted for passage of the ink therethrough to be supplied to the recording head of the ink jet printer in response to activation of the recording head, and an inlet port that is disposed upstream of said supplying port, said supplying chamber having an ink-flow inducing zone and an ink-holding zone disposed immediately downstream and upstream of said inlet port and said supplying port, respectively;

an ink absorbent body which is made of such a material as to hold the ink in voids thereof by capillary action in a saturated state, and to discharge the ink so that the ink in said voids in response to the activation of the recording head is partially depleted in said ink absorbent body, thereby placing said ink absorbent body in an unsaturated state, said ink absorbent body being configured to be received in said ink-holding zone such that, in the saturated and unsaturated states, said ink-flow inducing zone is air-tightly cut off from said supplying port by said ink absorbent body, and such that, in the unsaturated state, air in said ink-flow inducing zone takes the place of the depleted ink and refills said voids, thereby creating a reduced pressure in said ink-flow inducing zone;

an ink reservoir which contains ink with a liquid level, and which is disposed upstream of said inlet port; and a conduit having an intake end dipped in the ink below the liquid level, and an output end which is downstream of said intake end, and which is disposed in fluid communication with said inlet port such that, when the reduced pressure is created in said ink-flow inducing zone, the ink in said ink reservoir is suctioned through said conduit into said ink-flow inducing zone to replenish voids with ink, thereby placing said ink absorbent body to the saturated state;

wherein said ink reservoir is formed integrally with and is juxtaposed with said ink supplying member.

2. The ink cartridge of claim 1, wherein said ink supplying member has a bottom wall which is formed with a lower hole that serves as said supplying port, and a first top wall which is spaced apart from said bottom wall in an upright direction, which is formed with a first upper hole that serves as said inlet port, and which cooperates with said bottom wall to define said supplying chamber therebetween such that said ink-flow inducing zone and said ink-holding zone are opposite to each other in the upright direction.

3. The ink cartridge of claim 2, wherein said first top wall has a vent hole which is disposed to communicate said ink-flow inducing zone with the outside, and a cap which is detachably mounted in said vent hole.

4. The ink cartridge of claim 2, wherein said ink absorbent body is formed from a sponge material which has a plurality of pores to serve as the voids.

5. The ink cartridge of claim 2, wherein said ink reservoir has a second top wall which is disposed opposite to said first top wall in a transverse direction relative to the upright direction, and which has a second upper hole for passage of said intake end of said conduit into said ink reservoir, said conduit further having a tubular portion which is disposed outwardly of said ink reservoir and said supplying chamber and which has two ends connected to and fluidly communicated with said intake end and said output end, respectively.

6. The ink cartridge of claim 5, wherein said intake end is lower than said output end, respectively.

7. The ink cartridge of claim 6, wherein said second top wall further has an ink refilling port for refilling said ink reservoir with ink.

8. The ink cartridge of claim 1, wherein said ink reservoir is made of transparent material.

* * * * *